US011835185B2

(12) United States Patent
Wang

(10) Patent No.: US 11,835,185 B2
(45) Date of Patent: Dec. 5, 2023

(54) LAMP BULB WITH FLOWING TYPE LIGHT EFFECT

(71) Applicant: DONGGUAN HUIHUAN LIGHTING CO., LTD, Dongguan (CN)

(72) Inventor: Song Wang, Chengdu (CN)

(73) Assignee: DONGGUAN HUIHUAN LIGHTING CO., LTD

( * ) Notice: Subject to any disclaimer, the term of this patent is extended or adjusted under 35 U.S.C. 154(b) by 0 days.

(21) Appl. No.: 18/089,765

(22) Filed: Dec. 28, 2022

(65) Prior Publication Data

US 2023/0134858 A1 May 4, 2023

(30) Foreign Application Priority Data

Nov. 1, 2022 (CN) ..... 202222919548.9

(51) Int. Cl.

| | |
|---|---|
| ***F21K 9/232*** | (2016.01) |
| ***F21K 9/235*** | (2016.01) |
| ***F21K 9/238*** | (2016.01) |
| *F21Y 103/10* | (2016.01) |

(52) U.S. Cl.
CPC ..... *F21K 9/232* (2016.08); *F21K 9/238* (2016.08); *F21Y 2103/10* (2016.08)

(58) Field of Classification Search
CPC ..... F21K 9/232; F21K 9/238; F21Y 2103/10
See application file for complete search history.

(56) References Cited

U.S. PATENT DOCUMENTS

| | | | | |
|---|---|---|---|---|
| 11,598,492 | B1 * | 3/2023 | Wang | F21S 4/28 |
| 2005/0135098 | A1 | 6/2005 | Currie et al. | |
| 2007/0263385 | A1 * | 11/2007 | Fan | G09F 13/22 362/249.16 |
| 2013/0120973 | A1 | 5/2013 | Chen | |
| 2019/0195431 | A1 | 6/2019 | Chen et al. | |
| 2020/0056747 | A1 * | 2/2020 | Jiang | F21V 3/02 |
| 2021/0088189 | A1 * | 3/2021 | You | H05B 45/20 |

* cited by examiner

*Primary Examiner* — Tracie Y Green
(74) *Attorney, Agent, or Firm* — Jose Cherson Weissbrot

(57) ABSTRACT

The present disclosure relates to the technical field of lamps, and discloses a lamp bulb with a flowing type light effect. The lamp bulb includes a lamp base and a shell connected to the lamp base, and further includes a stem assembly. The present disclosure has the following advantages: 1. A large number of light-emitting chips can be integrated to achieve diversified flickering effects, and the volume of the lamp bulb can also be effectively controlled to facilitate the use. 2. The application range is wide, so that lamp bulbs in different sizes can achieve a flowing type light effect. 3. The light-emitting chips have high integration degree and low manufacturing cost.

10 Claims, 6 Drawing Sheets

LAMP BULB WITH FLOWING TYPE LIGHT EFFECT

TECHNICAL FIELD

The present disclosure relates to the technical field of lamps, in particular, to a lamp bulb with a flowing type light effect.

BACKGROUND

Decorative lamps can be seen everywhere in daily life. When night comes, the colorful light emitted by various decorative lamps can strongly set off and decorate surrounding environments. Since the decorative lamps have such an effect, many manufacturers are trying to introduce more innovative and colorful decorative lamps. A meteor shower lamp is a common decorative lamp. The existing meteor shower lamp is generally a long strip lamp tube. Light-emitting diode (LED) lamp beads are arranged and plugged on an internal circuit board. The LED lamp beads are controlled to emit light in turn, so that the light is as bright, natural and smooth as a meteor shower passing by.

Chinese patent CN201120200233.8 discloses an LED meteor shower lamp, including a transparent lamp tube (1) and a base plate (2) arranged in the lamp tube (1). A plurality of LED lamps (3) are arranged on the base plate (2). Lamp bases (4) are arranged at both ends of the base plate (2), and three electrodes (5) respectively connected to a null wire, a live wire and a ground wire are arranged on the lamp bases (4). The meteor shower lamp disclosed in this patent is a long strip, usually having a length greater than 20 cm and directly integrated with packaged LED lamp beads. However, for such a large-sized lamp with a meteor shower light effect, due to a large number of lamp beads that need to be integrated, at least 10 or more LED lamp beads need to be mounted. The packaged LED lamp beads also have a large volume. Therefore, a large carrier area is required, making it impossible to reduce the volume of the existing lamp with a meteor shower light effect to a suitable size range of an ordinary lamp bulb. Furthermore, the production cost is also high if the packaged LED beads are used. In view of this, the inventor has made a new invention.

SUMMARY

For the shortcomings in the prior art, the present disclosure aims to provide a lamp bulb with a flowing type light effect, which features with small volume, convenience of use and low cost.

In order to achieve the above objective, the present disclosure provides a lamp bulb with a flowing type light effect, including a lamp base and a shell connected to the lamp base, and further including a stem assembly; the stem assembly is connected to an opening portion of the shell; the stem assembly includes a plastic seat, and a first metal supporting wire, a printed circuit board (PCB) light source panel and a second metal supporting wire which are electrically connected in sequence; the plastic seat is connected to the opening portion of the shell; the plastic seat is provided with at least two accommodating holes for the metal supporting wires to pass; at least one side surface of the PCB light source panel is provided with two light-emitting chip groups; a conductive pattern is printed on the PCB light source panel; the PCB light source panel is also provided with a first integrated circuit (IC) controller; the first IC controller is electrically connected with light-emitting chip groups through the conductive pattern and turn on and circulate the light-emitting chip groups in sequence; one end of the first metal supporting wire and one end of the second metal supporting wire are both electrically connected to the lamp base; and the other ends are electrically connected to the PCB light source panel through a top of the plastic seat.

Preferably, the PCB light source panel is provided with a second IC controller with voltage reduction and rectification effects.

Preferably, the first IC controller and the second IC controller are respectively arranged at two ends of the PCB light source panel; and the PCB light source panel is also provided with an external package layer used for covering the light-emitting chip groups and the IC controllers.

Further, the first metal supporting wire and the second metal supporting wire are both electrically connected to the first IC controller.

Much further, two ends of the PCB light source panel respectively extend to be provided with a first conductive pin and a second conductive pin; the first conductive pin is electrically connected with the first metal supporting wire; and the second conductive pin is electrically connected with the second metal supporting wire.

Further, the conductive pattern includes an inlet pattern and a backflow pattern; one end of the inlet pattern and one end of the backflow pattern are electrically connected to the light-emitting chip groups; and the other ends of the inlet pattern and the backflow pattern are electrically connected to the first IC controller.

Further, the light-emitting chip groups include a plurality of LED chips connected in series; and a distance between the plurality of LED chips is 0.1 mm to 2.0 mm.

Further, the PCB light source panel is a ceramic base plate or a PC base plate.

Preferably, the first metal supporting wire is connected with a resistor a; the second metal supporting wire is connected with a resistor b; and the resistor a and the resistor b are both arranged in the accommodating holes and are in close fit.

Preferably, the accommodating holes are blind holes pierced by the metal supporting wires.

Beneficial effects: Compared with the prior art, the present disclosure discloses a lamp bulb with a flowing type light effect. The lamp bulb includes a lamp base and a shell connected to the lamp base, and further includes a stem assembly; the stem assembly is connected to an opening portion of the shell; the stem assembly includes a plastic seat, and a first metal supporting wire, a PCB light source panel and a second metal supporting wire which are electrically connected in sequence; the plastic seat is connected to the opening portion of the shell; the plastic seat is provided with at least two accommodating holes for the metal supporting wires to pass; at least one side surface of the PCB light source panel is provided with two light-emitting chip groups; a conductive pattern is printed on the PCB light source panel; and the PCB light source panel is also provided with a first IC controller. The present disclosure has the following advantages: 1. A large number of light-emitting chips can be integrated to achieve diversified flickering effects, and the volume of the lamp bulb can also be effectively controlled to facilitate the use. 2. The application range is wide, so that lamp bulbs in different sizes can achieve a flowing type light effect. 3. The light-emitting chips have high integration degree and low manufacturing cost.

REFERENCE NUMERALS INCLUDE

1: lamp base; 2: shell; 3: stem assembly; 31: plastic seat; 311: accommodating hole; 32: first metal supporting wire; 321: resistor a; 33: PCB light source panel; 331: light-emitting chip group; 332: conductive pattern; 333: inlet pattern; 334: backflow pattern; 335: LED chip; 34: second metal supporting wire; 341: resistor b; 35: first IC controller; 36: second IC controller; 37: external package layer; 38: first conductive pin; and 39: second conductive pin.

DETAILED DESCRIPTION OF THE EMBODIMENTS

Figure 1:
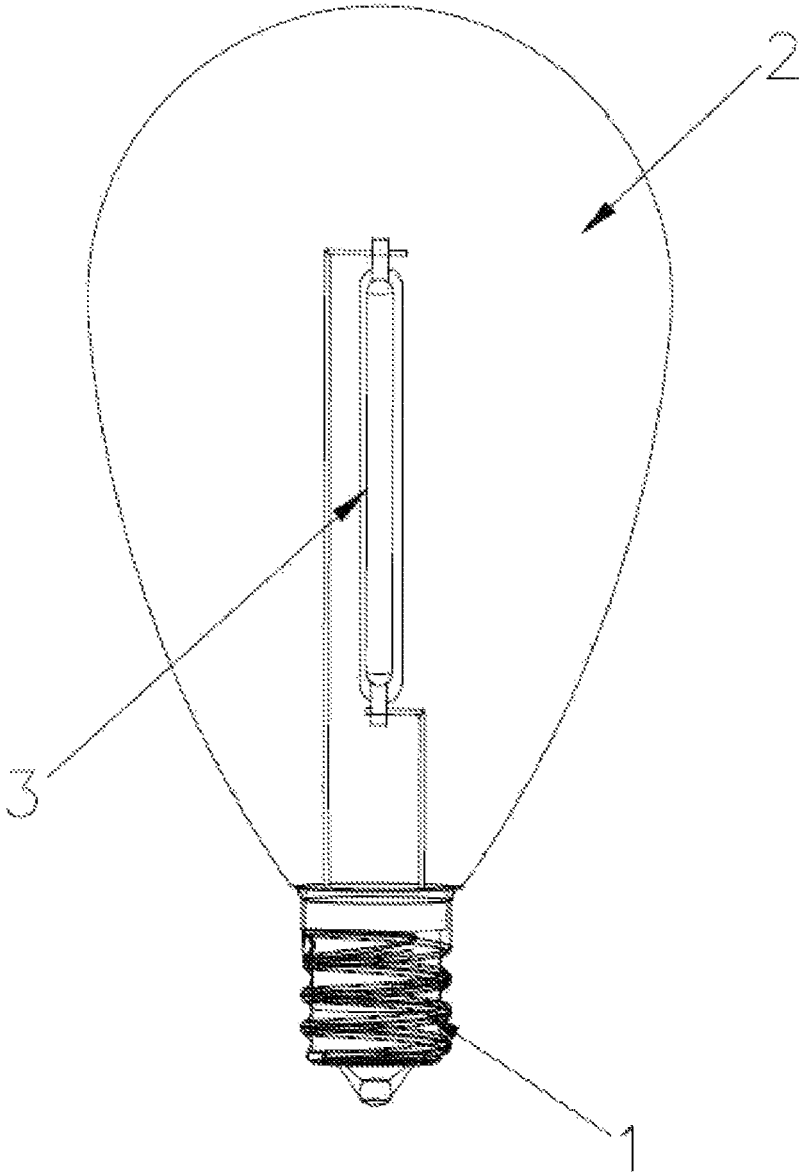
FIG. 1 is a schematic three-dimensional diagram of the present disclosure.
Figure 2:
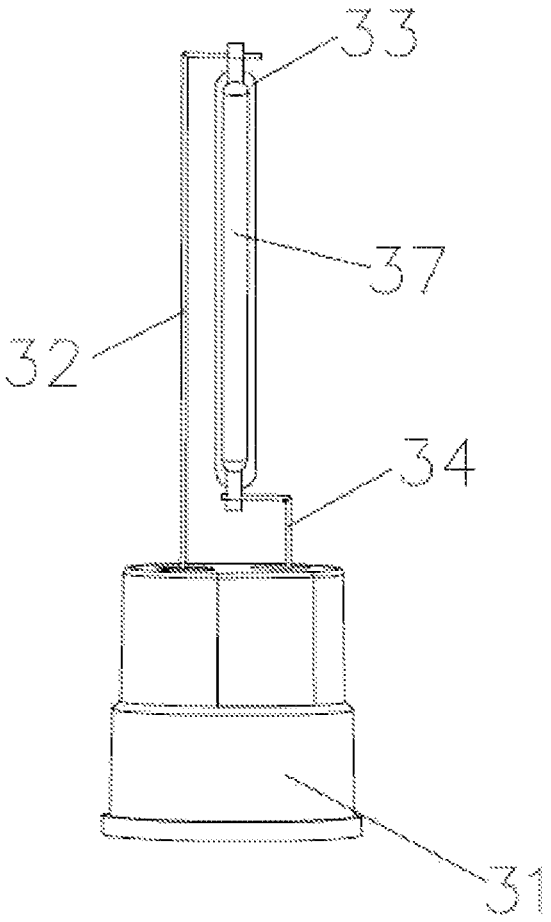
FIG. 2 is a schematic structural diagram of a stem assembly of the present disclosure.
Figure 3:
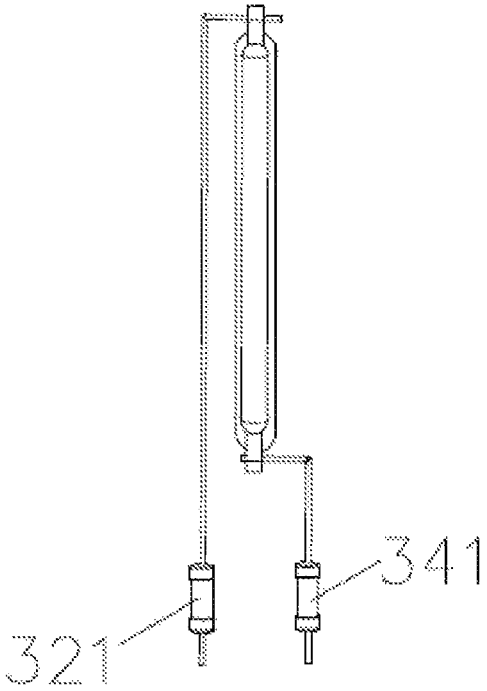
FIG. 3 is a schematic structural diagram of a metal supporting wire of the present disclosure.
Figure 4:
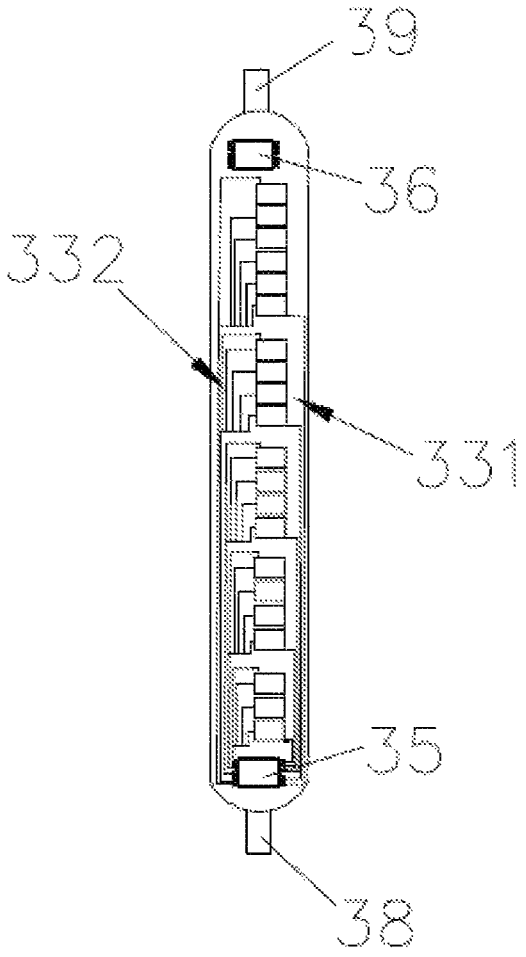
FIG. 4 is a schematic structural diagram of a PCB light source panel of the present disclosure.
Figure 5:
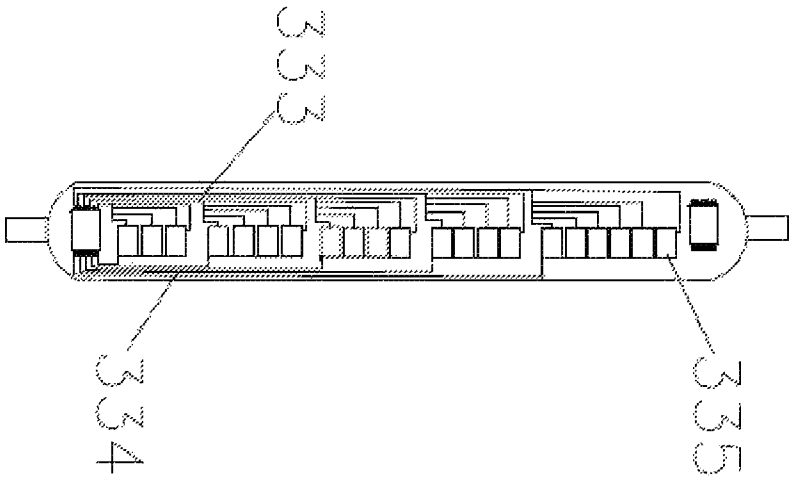
FIG. 5 is a schematic structural diagram of an LED chip of the present disclosure.
Figure 6:
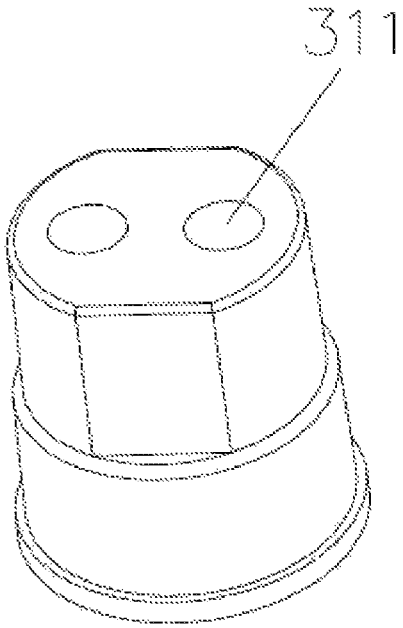
FIG. 6 is a schematic structural diagram of a plastic seat of the present disclosure.

The present disclosure is described in detail below in combination of FIG. 1-FIG. 6.

The present disclosure discloses a lamp bulb with a flowing type light effect, including a lamp base 1 and a shell 2 connected to the lamp base 1, and further including a stem assembly 3. The stem assembly 3 is connected to an opening portion of the shell 2. The stem assembly 3 includes a plastic seat 31, and a first metal supporting wire 32, a PCB light source panel 33 and a second metal supporting wire 34 which are electrically connected in sequence. The plastic seat 31 is connected to the opening portion of the shell 2. The plastic seat 31 is provided with at least two accommodating holes 311 for the metal supporting wires to pass. At least one side surface of the PCB light source panel 33 is provided with two light-emitting chip groups 331. A conductive pattern 332 is printed on the PCB light source panel 33. The PCB light source panel 33 is also provided with a first IC controller 35. The first IC controller 35 is electrically connected with light-emitting chip groups 331 through the conductive pattern 332 and turn on and circulate the light-emitting chip groups 331 in sequence. One end of the first metal supporting wire 32 and one end of the second metal supporting wire 34 are both electrically connected to the lamp base 1. The other ends are electrically connected to the PCB light source panel 33 through a top of the plastic seat 31.

When the lamp bulb of the present disclosure is powered on for use, current flows through the first IC controller 35 via the first metal supporting wire 32, and is then controlled to be transmitted to the plurality of light-emitting chip groups 331 in sequence by the first IC controller 35, so that the light-emitting chip groups 331 are lightened or extinguished in turn along an arrangement direction to achieve a flowing type light effect. When the lamp bulb is not used, the current flows back through the second metal supporting wire 34. Compared with a traditional long strip flowing type lamp tube, the present disclosure has the following advantages: 1. A large number of light-emitting chips can be integrated to achieve diversified flickering effects, and the volume of the lamp bulb can also be effectively controlled, thus avoiding an extremely large volume and facilitating the use. 2. The application range is wide, so that lamp bulbs in different sizes can achieve a flowing type light effect. 3. Compared with a packaged LED lamp bead finished product, the light-emitting chips have high integration degree and low manufacturing cost, and are more in line with the production idea of manufacturers.

In a further improved technical solution, the PCB light source panel 33 is provided with a second IC controller 36. The second IC controller 36 is electrically connected with the light-emitting chip groups 331. The second IC controller 36 is used for reducing a voltage of the light-emitting chip groups 331 to stabilize a voltage intensity, and also has a rectification effect to improve the stability of the overall lamp bulb and prolong the service life of the lamp bulb.

Preferably, in order to make the PCB light source panel 33 attractive, the first IC controller 35 and the second IC controller 36 are symmetrically arranged at two ends of the PCB light source panel 33 respectively. The PCB light source panel 33 is also provided with an external package layer 37 used for covering the light-emitting chip groups 331 and the IC controllers. The first IC controller 35 and the second IC controller 36 are symmetrically arranged at the two ends of the PCB light source panel 33, which will not affect the light effect of the lamp bulb, either. In another aspect, by the external package layer 37, the conductive pattern 332 between the light-emitting chip groups 331 and the IC controllers will not be damaged easily in an assembling process, so that the production cost is reduced. During coating of the external package layer 37, only the light-emitting chip groups 331 can be packaged. A material of the external package layer 37 is epoxy resin, polyurethane modified epoxy resin or polyurethane resin. These materials have the advantages of high-temperature resistance, good toughness, no pungent smell, and the like.

In the present disclosure, the first metal supporting wire 32 and the second metal supporting wire 34 are both electrically connected to the first IC controller 35. The first IC controller 35 is a control switch for multiple light-emitting chip groups 331. When the first IC controller 35 is a composite controller, that is, when it has backflow and power storage functions, the first IC controller 35 is electrically connected to the first metal supporting wire 32 serving as an anode, and anode current is input into the first IC controller 35. The first IC controller 35 transmits the current into the multiple light-emitting chip groups 331 and controls the light-emitting chip groups to achieve a flowing type light effect. After use, the current flows back via the second metal supporting wire 34. When the first IC controller 35 is only a drive controller, that is, when the first IC controller is internally provided with a programmed light-emitting chip and does not have a power storage function, the first metal supporting wire 32 constantly inputs anode current to the first IC controller 35, and the current flows through the light-emitting chip groups 331 and then flows back via the second metal supporting wire 34.

Preferably, two ends of the PCB light source panel 33 respectively extend to be provided with a first conductive pin 38 and a second conductive pin 39. The first conductive pin 38 is electrically connected with the first metal supporting wire 32. The second conductive pin 39 is electrically connected with the second metal supporting wire 34. The first conductive pin 38 and the second conductive pin 39 respectively extend and protrude from the two ends of the PCB light source panel 33, which is convenient for automatic equipment to weld the PCB light source panel 33 with the metal supporting wires, so that the assembling forming efficiency of the lamp bulb is further improved, and the production efficiency is improved.

In one embodiment, the conductive pattern 332 includes an inlet pattern 333 and a backflow pattern 334. The light-emitting chip groups 331 are provided with anodes and cathodes. One end of the inlet pattern 333 and one end of the backflow pattern 334 are electrically connected to the anodes and the cathodes of the light-emitting chip groups 331, and the other ends of the inlet pattern 333 and the backflow pattern 334 are electrically connected to the first IC controller 35. The conductive pattern 332 of the light-emitting chip group 331 farther from the first IC controller 35 is longer, so that the first IC controller 35 can be successfully communicated to the light-emitting chip groups 331 and controls a current to be made to the multiple light-emitting chip groups 331 in turn, and the multiple light-emitting chip groups are lightened in turn to achieve the flowing type light effect.

In this technical solution, to achieve the flowing type light effect, the lamp bulb is required to be provided with multiple light-emitting chip groups 331. The light-emitting chip groups 331 include a plurality of LED chips 335 connected in series. A space between the plurality of LED chips 335 is 0.1 mm to 2.0 mm, that is, there is a certain space between the plurality of LED chips 335, meaning that the plurality of LED chips cannot be stacked, but the largest space had better not exceed 2.0 mm, so as to prevent a discontinuous light effect caused by a large space. In the present disclosure, there are four light-emitting chip groups 331. The first group includes three LED chips; the second and third groups each include four LED chips; and the fourth group includes six LED chips.

In this technical solution, the PCB light source panel 33 can be a ceramic base plate or a PC base plate. The PC base plate is flexible and can be bent appropriately, so that when the PCB light source panel 33 is manually or mechanically automatically packaged, the PCB light source panel 33 is hard to damage, and has a better use effect and longer service life.

Preferably, the first metal supporting wire 32 is connected with a resistor a 321. The second metal supporting wire 34 is connected with a resistor b 341. The resistor a 321 and the resistor b 341 are both arranged in the accommodating holes 311 and are in close fit. The positions of the resistor a 321 and the resistor b 341 are limited using the accommodating holes 311, so as to avoid the impact of the movement of the resistors on the use of the lamp bulb. In this technical solution, the first metal supporting wire 32 and the second metal supporting wire 34 are provided with the resistor a 321 and the resistor b 341, which means that the resistor a 321 and the resistor b 341 are plugged in the middle portions of the first metal supporting wire 32 and the second metal supporting wire 34 or the first metal supporting wire 32 and the second metal supporting wire 34 are connected to the PCB light source panel 33 and then are connected to the lamp base 1 through additional wires. A main function of the resistor a 321 and the resistor b 341 is to prevent the stem assembly 3 from being damaged by an extremely high short-circuit current in the lamp bulb to achieve a current limiting effect. The resistor a and the resistor b can also achieve a heat dissipation effect if the lamp bulb is used constantly and generate a high temperature. In addition, the resistor a 321 and the resistor b 341 can also be integrated on the PCB light source panel 33 to further simplify the structure of the lamp bulb.

In this technical solution, the bottoms of the accommodating holes 311 are closed. The accommodating holes 311 are blind holes pierced by wires. The accommodating holes 311 are made into the bottom-closed blind holes, which is favorable for preventing water, wet air and the like from entering the shell 2 through the accommodating holes 311, so that the impact of fog produced in the shell 2 during use on the internal light source panel is avoided.

The above contents are only preferred embodiments of the present disclosure. Those of ordinary skill in the art can make changes to the specific implementations and application scopes according to the idea of the present disclosure, and the contents of this specification shall not be understood as restrictions to the present disclosure.

What is claimed is:

1. A lamp bulb with a flowing type light effect, comprising a lamp base (1) and a shell (2) connected to the lamp base (1), and further comprising a stem assembly (3), wherein the stem assembly (3) is connected to an opening portion of the shell (2); the stem assembly (3) comprises a plastic seat (31), and a first metal supporting wire (32), a printed circuit board (PCB) light source panel (33) and a second metal supporting wire (34) which are electrically connected in sequence; the plastic seat (31) is connected to the opening portion of the shell (2); the plastic seat (31) is provided with at least two accommodating holes (311) for the metal supporting wires to pass; at least one side surface of the PCB light source panel (33) is provided with two light-emitting chip groups (331); a conductive pattern (332) is printed on the PCB light source panel (33); the PCB light source panel (33) is also provided with a first integrated circuit (IC) controller (35); the first IC controller (35) is electrically connected with light-emitting chip groups (331) through the conductive pattern (332) and turn on and circulate the light-emitting chip groups (331) in sequence; one end of the first metal supporting wire (32) and one end of the second metal supporting wire (34) are both electrically connected to the lamp base (1); and the other ends are electrically connected to the PCB light source panel (33) through a top of the plastic seat (31).

2. The lamp bulb with the flowing type light effect according to claim 1, wherein the PCB light source panel (33) is provided with a second IC controller (36) with voltage reduction and rectification effects.

3. The lamp bulb with the flowing type light effect according to claim 2, wherein the first IC controller (35) and the second IC controller (36) are respectively arranged at two ends of the PCB light source panel (33); and the PCB light source panel (33) is also provided with an external package layer (37) used for covering the light-emitting chip groups (331) and the IC controllers.

4. The lamp bulb with the flowing type light effect according to claim 1, wherein the first metal supporting wire (32) and the second metal supporting wire (34) are both electrically connected to the first IC controller (35).

5. The lamp bulb with the flowing type light effect according to claim 1, wherein two ends of the PCB light source panel (33) respectively extend to be provided with a first conductive pin (38) and a second conductive pin (39); the first conductive pin (38) is electrically connected with the first metal supporting wire (32); and the second conductive pin (39) is electrically connected with the second metal supporting wire (34).

6. The lamp bulb with the flowing type light effect according to claim 1, wherein the conductive pattern (332) comprises an inlet pattern (333) and a backflow pattern (334); one end of the inlet pattern (333) and one end of the backflow pattern (334) are electrically connected to the light-emitting chip groups (331); and the other ends of the inlet pattern (333) and the backflow pattern (334) are electrically connected to the first IC controller (35).

7. The lamp bulb with the flowing type light effect according to claim 1, wherein the light-emitting chip groups (331) comprise a plurality of LED chips (335) connected in series; and a distance between the plurality of LED chips (335) is 0.1 mm to 2.0 mm.

8. The lamp bulb with the flowing type light effect according to claim 1, wherein the PCB light source panel (33) is a ceramic base plate or a PC base plate.

9. The lamp bulb with the flowing type light effect according to claim 1, wherein the first metal supporting wire (32) is connected with a resistor a (321); the second metal supporting wire (34) is connected with a resistor b (341); and the resistor a (321) and the resistor b (341) are both arranged in the accommodating holes (311) and are in close fit.

10. The lamp bulb with the flowing type light effect according to claim 1, wherein the accommodating holes (311) are blind holes pierced by the metal supporting wires.

* * * * *